US005082280A

United States Patent [19]

Wang

[11] Patent Number: 5,082,280

[45] Date of Patent: Jan. 21, 1992

[54] PUTTING PRACTICE DEVICE

[76] Inventor: Austin Wang, c/o Hung Hsing Patent Service Center, P.O. Box 55-1670, Taipei, Taiwan

[21] Appl. No.: 712,698

[22] Filed: Jun. 10, 1991

[51] Int. Cl.[5] ..... A63B 69/36

[52] U.S. Cl. ..... 273/179 C; 273/176 H; 273/195 B

[58] Field of Search ..... 273/176 H, 176 FB, 179 R, 273/195 B, 176 F, 176 FA, 176 J, 178 B, 179 C, 179 A, 179 B, 179 D, 179 E

[56] References Cited

U.S. PATENT DOCUMENTS 1,558,767 10/1925 Smith ..... 273/179 R
4,017,084 4/1977 Jeffrey ..... 273/176 FB
4,743,027 5/1988 Simjian ..... 273/176 H

*Primary Examiner*—George J. Marlo

[57] ABSTRACT

A golf putting practice board includes a slope-adjusting plate fixed on a biasing stick having a block member secured on a lower portion of the stick, and a socket member formed on a sloping base portion for universally engaging the block member to allow the slope-adjusting plate to be angularly, universally and adjustably mounted on the sloping base portion of the practice board having a surface mat covering the base portion, so that upon an optional adjustment of the slope-adjusting plate universally built in the base portion under the surface mat, a plurality of sloping surfaces of the practice board can be adjustably obtained to simulate an actual putting green to enhance a player's skill for practicing a sliced line, a hooked line or a curved line tracked by a golf ball.

3 Claims, 3 Drawing Sheets

PUTTING PRACTICE DEVICE

BACKGROUND OF THE INVENTION

A conventional golf putting practice or training device includes a sloping base covered with a mat made of artificial grass having a ball hole recessed in a rear portion of the base so that a golf player may practice a putting stroke by rolling a golf ball along a sloping surface of the mat formed on the sloping base until rolling into the ball hole.

However, such a conventional putting practice device is made as a fixed type and can not be optionally adjusted for variating a sloping angle or sloping direction of the mat and the sloping base. It is therefore difficult to simulate an actual golf course such as to imitate an irregular, inclined, or corrugated surfaces met in a putting green, thereby lacking of playing interest and training efficiency.

It is therefore expected to disclose a putting practice device which is adjustable for optically changing a sloping angle of a sloping board adapted for practicing a putting stroke by a golf player or trainee.

SUMMARY OF THE INVENTION

The object of the present invention is to provide a golf putting practice board including a slope-adjusting member angularly, universally and adjustably mounted on a sloping base portion having a surface mat covering the base portion, so that upon an optional adjustment of the slope-adjusting plate universally built in the base portion under the surface mat, a plurality of sloping surfaces of the practice board can be adjustably obtained to simulate an actual putting green to enhance a player's skill for practicing a sliced line, a hooked line or a curved line tracked by a golf ball.

DETAILED DESCRIPTION

Figure 1:
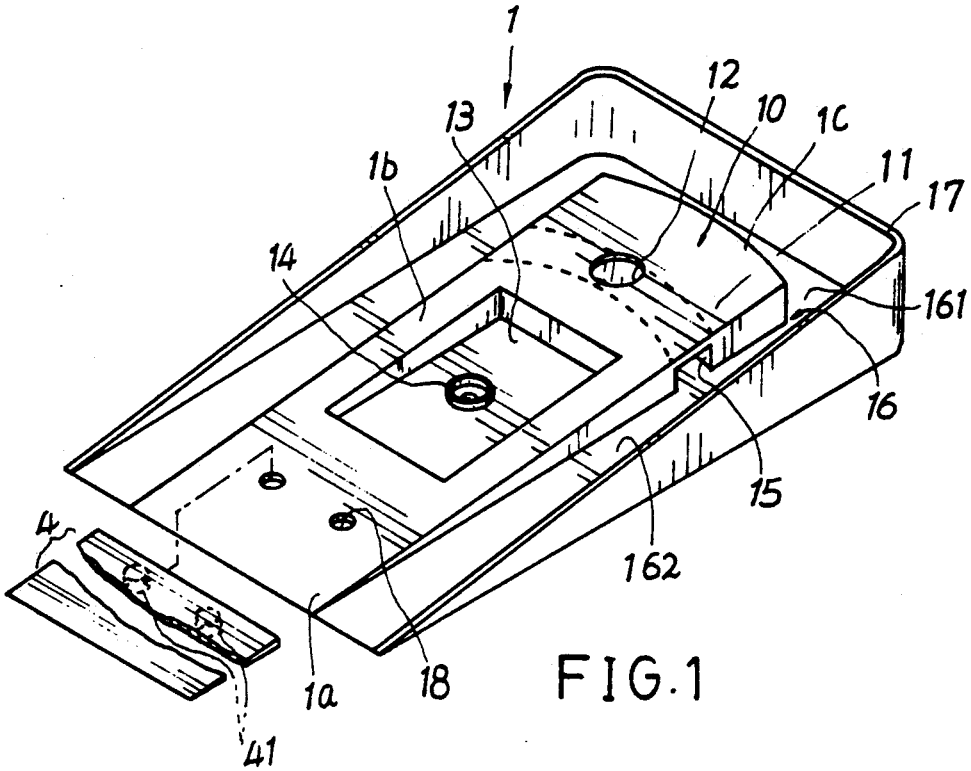
FIG. 1 is a perspective view of a base portion by removing a surface mat of the present invention.

As shown in the drawing figures, the present invention comprises: a sloping board 1, a slope-adjusting means 2, a surface mat 3, and an access plate 4.

The sloping board 1 includes: a base portion 10 convexly formed on a central portion of the board 1, an upper sloping surface 11 inclinedly longitudinally formed on an upper portion of the base portion 10 tapered frontwardly, a ball hole 12 recessed in a rear portion 1*c* of the base portion 10, a central recess portion 13 recessed in a central portion 1*b* of the base portion 10 for mounting the sloping-adjusting means 2 in the recess portion 13, a holder means 14 formed in a central portion of the recess portion 13, a plurality of front holes 18 formed in a front wedge portion 1*a* of the base portion 10, an arcuate sloping tunnel 15 transversely formed in the board 1 communicated with the ball hole 12 arcately sloping sidewardly and downwardly on the sloping board 1, a barrier wall 17 disposed around a circumferential edge of the board 1 defining a U-shaped sloping channel 16 between the base portion 10 and the wall 17 having a rear arcuate sloping channel section 161 formed in a rear portion of the board 1 behind ball hole 12 and two side sloping channel sections 162 connected with two opposite side portions of the rear channel section 161 and sloping downwardly frontwardly for automatically rolling a golf ball downwardly frontwardly towards a player standing in front of the board 1.

The barrier wall 17 is higher than the central base portion 10. The board 1 may be made by integrated molding process to form an unitary board.

Figure 2:
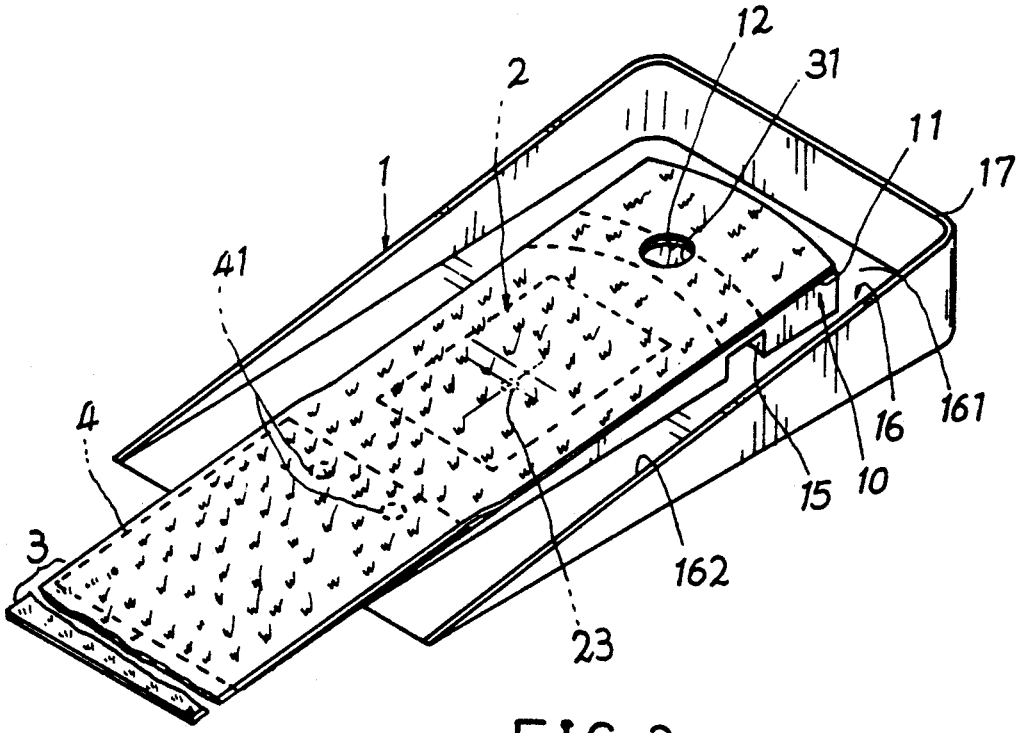
FIG. 2 is a perspective view of the present invention.

The surface mat 3 made of artificial grass is provided to cover the central base portion 10 as shown in FIG. 2 having an upper ball hole 31 matching with the ball hole 12 in the base portion 10. The mat 3 can be extended in its length frontwardly beyond the front wedge portion 1*a* of the base portion 10 corresponding to the access plate 4 packed under the mat 3 having a plurality of bottom protrusions 41 formed on a bottom of the access plate 4 engageable with the front holes 18 formed in the board 1. The length of the access plate 4 is not limited in this invention. By the way, the board 1 can be connected with such a plate 4 in order to reduce a length or size of the board for forming a compact unit, convenient for portable and storage uses.

The slope-adjusting means 2 includes: a slope-adjusting member 21 generally engageable with the recess portion 13 of the base portion 10 having a fixing hole 22 formed in a bottom portion of the slope-adjusting member 21, and a universal supporting means 20 retained in the holder means 14 for universally securing the slope-adjusting member 21 on the base portion 10.

Figure 6:
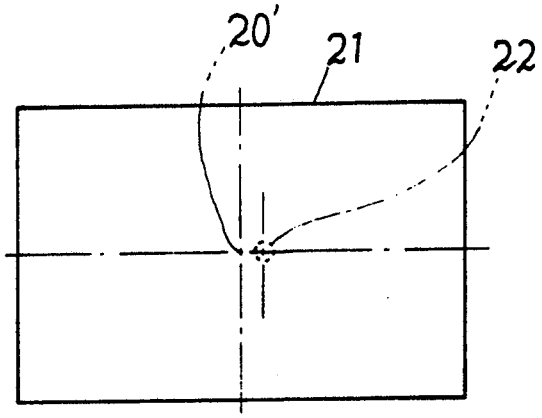
FIG. 6 is a plan view of a slope-adjusting member of the present invention.

The fixing hole 22 is preferably eccentric to a center portion or gravity center 20' as shown in FIG. 6, but not necessarily. The holder means 14 may also be adjustably mounted on the base portion 10.

Figure 4:
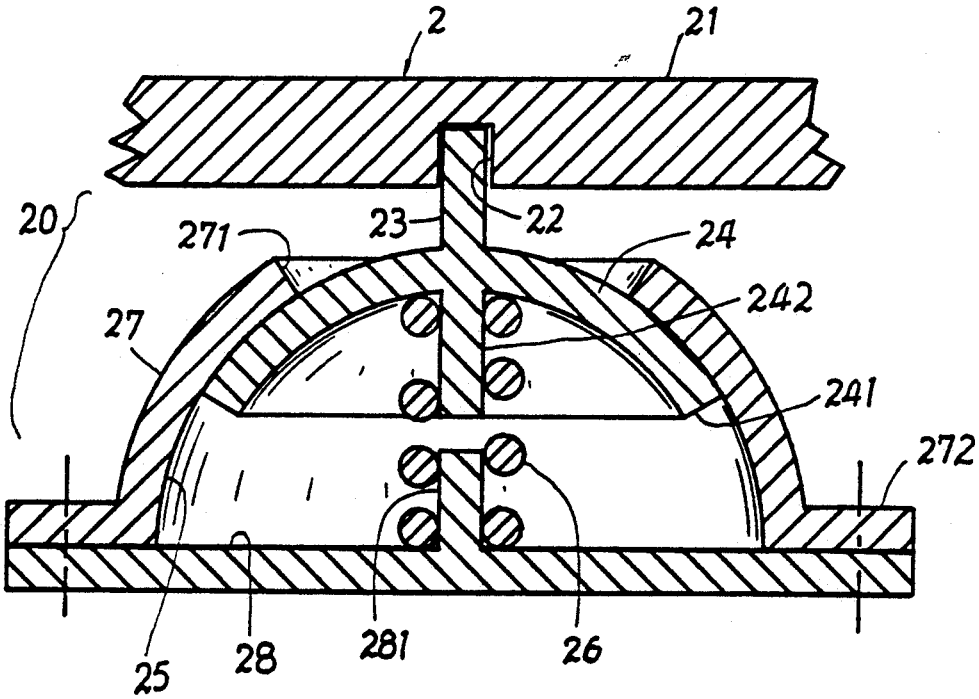
FIG. 4 is a sectional drawing of a slope-adjusting means of the present invention.
Figure 5:
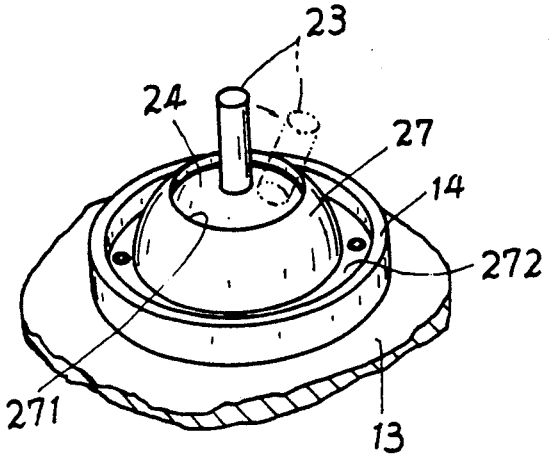
FIG. 5 is a perspective illustration showing the slope-adjusting means of the present invention.

The universal supporting means 20 includes: a biasing stick 23 fixed into the fixing hole 22 of the slope-adjusting member 21, a block member 24 secured with the biasing stick 23 and generally spherical or semi-spherical shaped, socket member 27 defining a hollow portion 25 generally spherical shaped in the socket member 27 and universally coupling the block member 24, a lower plate 28 secured with the socket member 27, and a tensioning spring 26 resiliently tensioning the block member 24 in the socket member 27 as shown in FIGS. 4, 5.

The block member 24 includes an enlarged lower portion 241 having a diameter larger than a diameter of an upper socket opening 271 of the socket member 27 to ensure a coupling of the block member 24 with the socket member 27, and an upper stem 242 formed in the block member 24 for retaining an upper spring end of the tensioning spring 26 of which a lower spring end is retained on a lower stem 281 formed on the lower plate 28. The lower stem 281 may also be eliminated.

Figure 3:
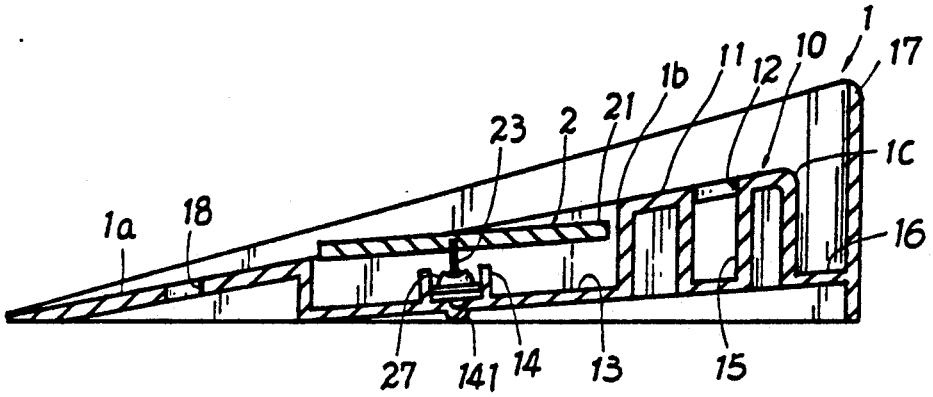
FIG. 3 is a sectional drawing of the present invention.

The lower plate 28 is combinably secured with a lower flange 272 formed on a lower portion of the socket member 27 and is embedded or fixed into the holder means 14 having a bottom tip 141 laid on a floor surface as shown in FIG. 3.

The slope-adjusting member 21 may be universally mounted on the base portion 10 by other coupling means, which is not limited in this invention.

In using the present invention, the slope-adjusting member 21 may be obliquely pushed by a player's hand, foot or a golf club to be angularly positioned on the base portion 10 to simulate a sloping surface of a golf course such as a putting green. Since the member 21 is universally mounted on the universal supporting means 20, any orientation of the member 21 can be optionally adjusted to obtain a free-oriented sloping surface of the member 21 and the surface mat 3 overlain on the member 21 and on the base portion 10. For preventing separation of the mat 3 from the base portion 1, an adhesive may be partially coated on a bottom portion of the mat 3 which is then adhered on the base portion 10. The mat 3 is formed to cover the base portion 10, and cover the access plate 4 extendibly secured to the front wedge portion 1*a* of the base portion 10, but without shielding the U-shaped sloping channel 16.

After putting a golf ball to roll on the sloping mat 3 and base portion 10, the ball will be rolled on a central mat portion supported by the slope-adjusting member 21 under the mat 3 having an adjusted slope before entering the ball hole 12, thereby practicing a sliced line, a hooked line or a curved line tracked by the ball. The member 21 is stably held on the stick 23 as urged by the tensioning spring 26 without being easily collapsed.

Therefore, the present invention can easily adjust a slope to simulate an actual green of a golf course having diversified sloping surfaces for enhancing the player's putting skill and exciting his or her putting game.

The ball once rolling into the hole 12 will be gravitationally rolled downwardly through the arcuate tunnel 15 and the U-shaped channel 16 for automatically returning to a location where the player stands.

The fixing hole 22 of the plate 21 is eccentric to its gravity center so as to always pose the member 21 at an inclined state.

The member 21 may also be partially coated with adhesive or velcro tape or may be made with a roughly frictional surface to be adhered with the surface mat 3 so that the angular adjustment of the member 21 will cooperatively move the surface mat 3 covered on the member 21 for effectively adjusting the slope of the present invention.

I claim:

1. A golf putting practice apparatus comprising:

a sloping board having a base portion formed on a central portion of the board having an upper sloping surface tapered frontwardly formed on the base portion, a ball hole recessed in a rear portion of said base portion, and a central recess portion recessed in a central portion of said base portion beyond said ball hole;

a slope-adjusting means formed in said central recess portion in said base portion; and a surface mat covering said base portion and said slope-adjusting means;

said slope-adjusting means being angularly adjustably mounted on said base portion, so that upon a golfer manually pushing said slope-adjusting means by acting a mat portion corresponding to said slope-adjusting means positioned under said mat, a slope of the mat will be adjusted to simulate a sloping surface of an actual golf course for practice purpose;

said slope-adjusting means including a slope-adjusting member universally mounted on a universal supporting means formed in a central portion of said central recess portion of said base portion;

said universal supporting means including: a biasing stick fixed into a fixing hole formed in a bottom portion of the slope-adjusting member, a generally spherically shaped block member secured with the biasing stick, a generally spherically shaped socket member defining a hollow portion in said central recess portion and universally coupling the block member therein, a lower plate secured with the socket member, and a tensioning spring resiliently tensioning the block member in the socket member, said universal supporting means fixed in a holder means formed in a central portion of said central recess portion of the base portion; and said block member including an enlarged lower portion having a diameter larger than a diameter of an upper socket opening of the socket member to ensure a coupling of the block member with the socket member, and an upper stem formed in the block member for retaining an upper end of a tensioning spring of which a lower end is retained on a lower stem formed on the lower plate.

2. A golf putting practice apparatus according to claim 1, wherein said lower plate of said universal supporting means is combinably secured with a lower flange formed on a lower portion of the socket member and is fixed into the holder means of said base portion having a bottom tip of said holder means protruding downwardly to be laid on a floor surface.

3. A golf putting practice apparatus according to claim 1, wherein said slope-adjusting member is formed with a fixing hole eccentric to a center or a gravity center of said slope-adjusting member to be engageably fixed on said biasing stick of said universal supporting means.

* * * * *